US007509082B2

(12) United States Patent
Goto

(10) Patent No.: US 7,509,082 B2
(45) Date of Patent: Mar. 24, 2009

(54) IMAGE FORMING APPARATUS AND METHOD OF CONTROLLING THE SAME

(75) Inventor: Tatsuya Goto, Abiko (JP)

(73) Assignee: Canon Kabushiki Kaisha (JP)

( * ) Notice: Subject to any disclaimer, the term of this patent is extended or adjusted under 35 U.S.C. 154(b) by 252 days.

(21) Appl. No.: 11/468,682

(22) Filed: Aug. 30, 2006

(65) Prior Publication Data

US 2007/0053727 A1 Mar. 8, 2007

(30) Foreign Application Priority Data

Sep. 2, 2005 (JP) ..... 2005-255622
Jun. 26, 2006 (JP) ..... 2006-175573

(51) Int. Cl.
*G03G 15/00* (2006.01)
*G03G 15/01* (2006.01)

(52) U.S. Cl. ..... 399/301; 399/49; 399/72; 399/394; 399/395; 399/396

(58) Field of Classification Search ..... 399/301, 399/49, 72, 394, 395, 396; 347/116
See application file for complete search history.

(56) References Cited

U.S. PATENT DOCUMENTS 5,287,162 A * 2/1994 de Jong et al. ..... 399/49
5,339,150 A * 8/1994 Hubble et al. ..... 399/49
5,909,235 A * 6/1999 Folkins ..... 347/240
6,008,826 A * 12/1999 Foote et al. ..... 347/116
6,052,552 A * 4/2000 Ohsumi et al. ..... 399/394
6,380,960 B1 * 4/2002 Shinohara ..... 347/116
6,493,533 B1 * 12/2002 Munakata ..... 399/301
6,804,479 B2 * 10/2004 Kimura ..... 399/49
7,130,551 B2 * 10/2006 Kobayashi ..... 399/49
7,257,339 B2 * 8/2007 Yokoyama et al. ..... 399/66
7,324,769 B2 * 1/2008 Yamaoka ..... 399/49
2004/0184828 A1 * 9/2004 Bannai et al. ..... 399/49
2005/0007440 A1 1/2005 Nishikawa (Continued)

FOREIGN PATENT DOCUMENTS

JP 10-148992 A 6/1998

(Continued)

OTHER PUBLICATIONS

Office action issued in Japanese application No. 2006-175573, dated Aug. 5, 2008.

(Continued)

*Primary Examiner*—David M Gray
*Assistant Examiner*—G. M. Hyder
(74) *Attorney, Agent, or Firm*—Rossi, Kimms & McDowell LLP

(57) ABSTRACT

A pattern image for registration correction is formed in a reference color and an arbitrary color to be corrected. The pattern image for registration correction is formed a number or times n1 or a number of times n2. If the total number of image forming sections is S; the length of sheets is L; the sheet-to-sheet distance is d; and the belt conveying distance corresponding to one revolution of a drive roller is A, n1 satisfies $((L+d)\times(S-1)/A)\times n1=N1$ (where n1 is an integer and N1 is an approximate integer), and n2 satisfies $((L+d)/A)\times n2=N2$ (where n2 is an integer, and N2 is an approximate integer).

8 Claims, 14 Drawing Sheets

U.S. PATENT DOCUMENTS

2005/0052488 A1* 3/2005 Inoue ..... 347/19

FOREIGN PATENT DOCUMENTS

JP 2002-014507 A 1/2002

JP 2005-114980 A 4/2005

OTHER PUBLICATIONS

Partial English translation of extended search report, dated Aug. 5, 2008, issued in corresponding JP application No. 2006-175573. The search report was previously submitted with an IDS filed on Sep. 2, 2008.

* cited by examiner

IMAGE FORMING APPARATUS AND METHOD OF CONTROLLING THE SAME

BACKGROUND OF THE INVENTION

1. Field of the Invention

The present invention relates to a technique of correcting registration in an image forming apparatus using an electrostatic recording system, an electrophotographic recording system or the like.

2. Description of the Related Art

In a color image forming apparatus, a color image is formed by superposing images of different colors on one another. This image forming requires forming the plurality of images of different colors at correct positions without relative misalignment.

In a color image forming apparatus using an intermediate transfer belt, there is a possibility of expansion and contraction of an image according to the period of rotation of a drive roller for driving the intermediate transfer belt due to driving nonuniformity of the drive roller or the like. A technique of reducing the influence of image expansion and contraction due to driving nonuniformity of a drive roller has been proposed (Japanese Patent Laid-Open No. 2002-014507). According to the proposition, a pattern image used for correction of registration is formed at a plurality of positions to cancel the influence of image expansion/contraction. A plurality of groups of data on the formed pattern images are obtained by reading the images. An average of the amounts of misalignment is obtained from the plurality of data groups obtained. This average is a value at which the influence of image expansion and contraction is cancelled. Therefore, if correction processing is performed by using the average, the correction accuracy is improved.

For example, ten pattern images are formed with respect to nine periods of a drive roller 32, as shown in FIG. 13. Sampling times are thereby distributed uniformly in one period of the drive roller, as shown in FIG. 14. Thus, the influence of image expansion and contraction is suitably cancelled. More specifically, "misalignments" due to image expansion and contraction are cancelled as between phases p1 and p6, phases p2 and p7, phases p3 and p8, phases p4 and p9, and phases p5 and p10.

The method of increasing sample values of the pattern images and performing averaging process as described above is effective in reducing the influence of image extraction and contraction. However, if sample values are excessively increased, a problem arises that the correction processing time is increased and the consumption of toners for forming the pattern images is increased. Further, an increased load is imposed on the cleaning member for cleaning of the formed pattern images. Therefore it is desirable to minimize the number of pattern images.

It is preferable to form the pattern image in a space area (sheet-to-sheet space) arisen between the area in which the kth (k: an integer) output image is formed and the area in which (k+1)th output image is formed in order to correct registration while maintaining the desired productivity. However, if the pattern image is formed in the sheet-to-sheet space, there is a possibility of a restriction on the length of the image forming medium in the medium conveying direction, the width of the sheet-to-sheet space (the length in the conveying direction) or the frequency with which the pattern image is repeatedly formed, depending image forming modes. Needless to say, unless the pattern image is formed at a suitable position according to the cycle of rotation of the drive roller, the bad influence of the drive roller cannot be cancelled and an improvement in correction accuracy cannot be expected.

SUMMARY OF THE INVENTION

According to the present invention, there is provided an image forming apparatus including: a rotating member which is one of an intermediate transfer member and a rotating conveyer which conveys an image forming medium, the intermediate transfer member temporarily holds an image to be transferred onto the image forming medium; a drive roller which drives the rotating member; a plurality of image forming sections which respectively form images of different colors on the rotating member or the image forming medium; a control section which forms a pattern image by using the image forming sections in a space area on the rotating member arisen between a first area in which an image corresponding to the first image forming medium is formed and a second area in which an image corresponding to the second image forming medium is formed; and a correction section which corrects the positions at which the images are formed on the basis of a plurality of the formed pattern images. The control section determines the number of times n the pattern image is formed with respect to each color, by using the following equation:

$$[J\times(L+d)\times m/A]\times n=N$$

defined by a frequency of arising a sheet-to-sheet space J with which the pattern image is formed, the length L of the image forming medium, the width d of the space area, the number m of the image forming sections performing correction, the conveying distance A passed by the rotating member while the drive roller rotates through one revolution, and an integer n.

The control section controls the image forming sections so that the image forming sections form the pattern image the number of times n such that N is a value close to an integer.

According to the present invention, the suitable number of times n the pattern image is formed is determined by considering parameters, e.g. the length L of the image forming medium, the width d of the space area and the conveying distance A passed by the rotating member while the drive roller rotates through one revolution, with respect to each image forming mode. In this way, it is possible to execute registration correction with accuracy while reducing the loads on the sections of the image forming apparatus.

Further features of the present invention will become apparent from the following description of exemplary embodiments (with reference to the attached drawings).

DESCRIPTION OF THE EMBODIMENTS

Embodiments of the present invention useful for understanding of the present invention will be described below. Needless to say, the present invention is not limited to the embodiments described below. The first embodiment will be described with respect to a case where a predetermined integer m is equal to S−1 in particular. S is the total number of image forming sections. The second embodiment will be described with respect to a case where the predetermined integer m is equal to 1. The third embodiment will be described with respect to an example adopting the smaller n in which n number of times is determined when m=1 and when m=S−1. The fourth embodiment will be described with respect to a case where a plurality of densities of each color are set and detected.

First Embodiment

Figure 1:
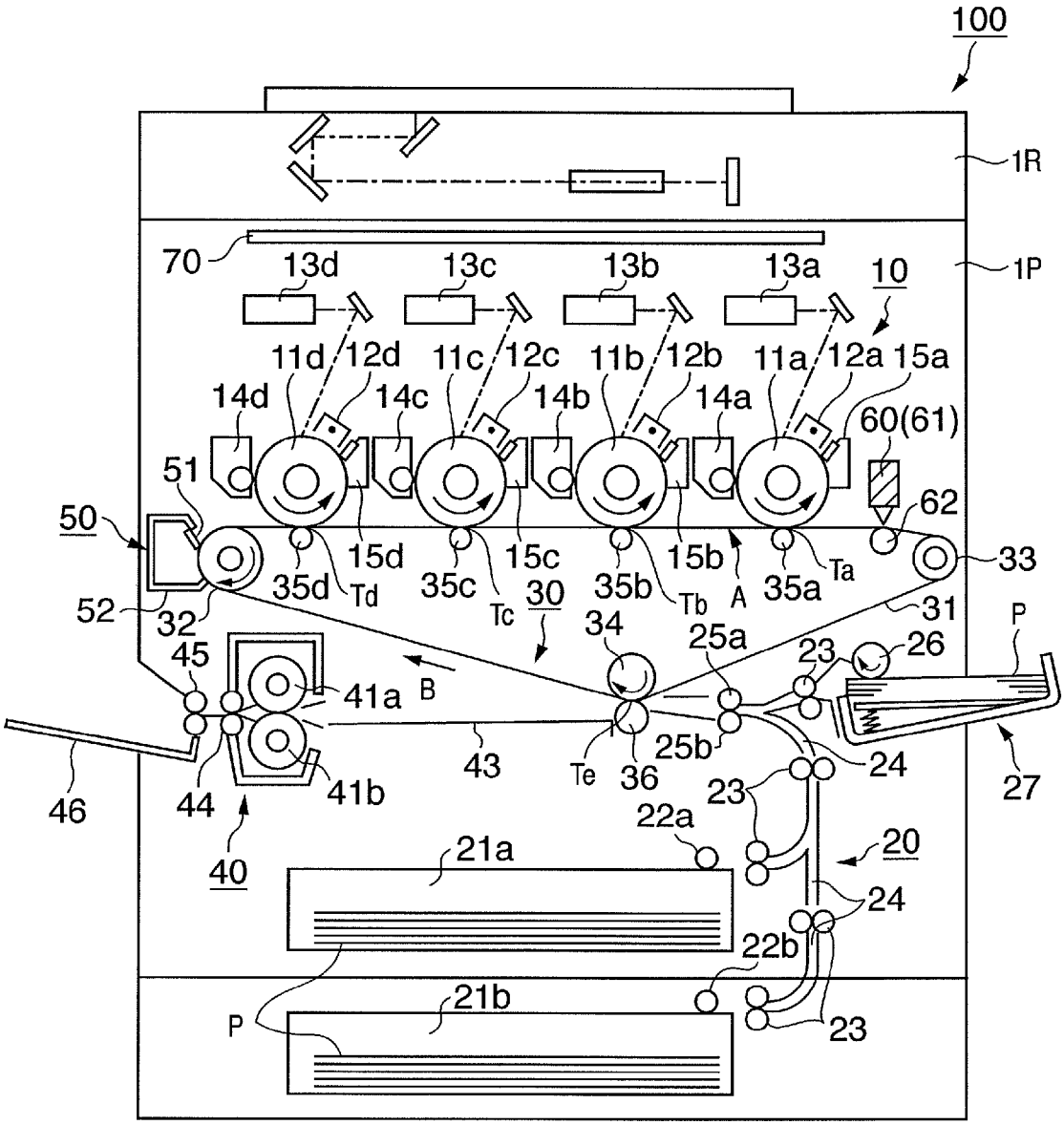
FIG. 1 is a sectional view of essential portions of an example of an image forming apparatus according to an embodiment of the present invention.

FIG. 1 is a sectional view of essential portions of an example of an image forming apparatus according to the embodiment. This example of the image forming apparatus is a color image forming apparatus 100 having four image forming sections arranged side by side. That is, an image output section 1P is constituted by an image forming unit 10 divided generally into four image forming sections, a sheet feed unit 20, an intermediate transfer unit 30, a fixing unit 40 and a control unit 70.

The image forming unit 10 has main components described below. Photosensitive drums 11*a*, 11*b*, 11*c*, and 11*d* are image bearing bodies rotated in the directions of the arrow. Each of the photosensitive drums 11*a*, 11*b*, 11*c*, and 11*d* is axially supported at its center. Primary chargers 12*a*, 12*b*, 12*c*, and 12*d*, optical systems 13*a*, 13*b*, 13*c*, and 13*d* and development devices 14*a*, 14*b*, 14*c*, and 14*d* are disposed in the direction of rotation of the photosensitive drums 11*a* to 11*d* so as to face the outer peripheral surfaces of the photosensitive drums 11*a* to 11*d*.

In the primary chargers 12*a* to 12*d*, uniform amounts of charge are applied to the surfaces of the photosensitive drums 11*a* to 11*d*. Subsequently, the photosensitive drums 11*a* to 11*d* are exposed by the optical systems 13*a* to 13*d* to light beams, e.g., laser beams modulated according to a recording image signal. Electrostatic latent images are thereby formed on the photosensitive drums 11*a* to 11*d*. The electrostatic latent images are developed as toner images by the development device 14*a* to 14*d* respectively containing developers (toners) of four colors: yellow, cyan, magenta and black. In image primary transfer regions Ta, Tb, Tc, and Td, the developed toner images are transferred onto the intermediate transfer belt 31 provided as an intermediate transfer member. On the downstream sides of the image primary transfer regions Ta, Tb, Tc, and Td, toners remaining on the photosensitive drums 11*a* to 11*d* without being transferred onto an image forming medium P are scraped off by cleaning devices 15*a*, 15*b*, 15*c*, and 15*d*. In the above-described process, the image forming steps using the toners are successively performed.

The sheet feed unit 20 has cassettes 21*a* and 21*b* for storage of image forming medium P, a manual feed tray 27, and pickup rollers 22*a*, 22*b*, and 26 for feeding sheets of image forming medium P one by one from the cassettes 21*a* and 21*b* and the manual feed tray 27. Pairs of sheet feed rollers 23 and sheet feed guide 24 convey the image forming medium P fed out of the pickup roller 22*a*, 22*b*, or 26 to registration rollers 25*a* and 25*b*. The registration rollers 25*a* and 25*b* feed the image forming medium P to a secondary transfer region Te according to image forming timing in the image forming unit 10.

The intermediate transfer unit 30 has the intermediate transfer belt 31 provided as an intermediate transfer member or a bearing body. The intermediate transfer belt 31 is wrapped around a driver roller 32 through which a drive force is transmitted to the intermediate transfer belt 31, a backup roller 62, a tension roller 33 and a secondary transfer inner roller 34. The backup roller 62 faces a detection sensor 60. The tension roller 33 applies a suitable tension to the intermediate transfer belt 31 by the urging force of a spring (not shown). The secondary transfer roller 34 faces the secondary transfer region Te, with the intermediate transfer belt 31 interposed therebetween. The intermediate transfer belt 31 is selected, for example, from polyimide (PI), polyvinylidene fluoride (PVdF) and the like.

A primary transfer surface A is formed between the drive roller 32 and the backup roller 62. The drive roller 32 is a metallic roller having a several millimeter thick rubber (urethane or chloroprene) coating formed on its surface for prevention of slippage from the intermediate transfer belt 31. The drive roller 32 is driven and rotated by a pulse motor (not shown).

Alignment of the tension roller 33 urged by a pressing mechanism (not shown) can be controlled to correct meandering of the intermediate transfer belt 31. At the primary transfer regions Ta to Td, primary transfer devices 35*a* to 35*d* are disposed on the back sides of the intermediate transfer belt 31. A cleaning device 50 for cleaning the image formation surface of the intermediate transfer belt 31 is disposed downstream of the secondary transfer region Te on the intermediate transfer belt 31. The cleaning device 50 is constituted by a cleaner blade 51 and a waste toner box 52 which stores a waste toner. Polyurethane rubber or the like is used as the material of the cleaner blade 51.

The fixing unit 40 is constituted by a fixing roller 41*a*, a pressure roller 41*b* pressed against the fixing roller 41*a*, a conveying guide 43, inner discharge rollers 44 and outer discharge rollers 45. The fixing roller 41*a* has a heat source such as a halogen heater provided therein. The pressure roller 41*b* may also have a heat source. The conveying guide 43 guides the image forming medium P to a nip between the fixing roller 41*a* and the pressure roller 41*b*. The inner discharge rollers 44 and the outer discharge rollers 45 guide the image forming medium P discharged from the fixing roller 41*a* and the pressure roller 41*b* to discharge the medium out of the apparatus.

The control unit 70 is constituted by a control board, a motor drive board (not shown) and other components for controlling the operations of the mechanisms in each unit. For example, various control circuit components including a central processing unit (CPU), a read-only memory (ROM) and a random access memory (RAM) are mounted on the control board. A control program such as a piece of firmware is stored in the ROM.

The operation of the color image forming apparatus 100 will be described. When a signal is issued from an operating section or the like to start the image forming operation, sheets of image forming medium P are fed out of the cassette 21*a* one by one by the pickup roller 22*a*. Each sheet of image forming medium P is carried to the registration rollers 25*a* and 25*b* by the pairs of sheet feed rollers 23 while being guided between the sheet feed guide 24. At this time, the registration rollers 25*a* and 25*b* are stopped, and the leading end of the sheet of image forming medium P is brought into abutment on the nip. The image forming unit 10 thereafter starts image forming. The rotation of the registration rollers 25*a* and 25*b* is started simultaneously with the start of image forming. The time at which the rotation of the registration rollers 25*a* and 25*b* is started is set so that the sheet of image forming medium P and the toner image transferred onto the intermediate transfer belt 31 by primary transfer just coincide with each other in the secondary transfer region Te.

In the image forming unit 10, on the other hand, when the above-mentioned start signal is issued, the toner image formed on the photosensitive drum 11*d* in the uppermost upstream position in the direction of rotation of the intermediate transfer belt 31 is transferred onto the intermediate transfer belt 31 by primary transfer. The toner image transferred onto the intermediate transfer belt 31 by primary transfer is carried to the next primary transfer region Tc. In the primary transfer region Tc, image forming is performed with a delay corresponding to the time period required to carry the toner image between the image forming sections. That is, the next toner image is transferred by being correctly positioned on the toner image already formed. Such adjustment of the positions at which a plurality of color images of different colors are formed is called registration. The same steps are repeated to complete primary transfer of the four color toner images onto the intermediate transfer belt 31.

The image forming medium P thereafter enters the secondary transfer region Te to be brought into contact with the intermediate transfer belt 31. In correspondence with the timing of passage of the image forming medium P, a high voltage is applied to a secondary transfer device 36. The four color toner images formed on the intermediate transfer belt 31 by the above-described process are thereby transferred onto the surface of the image forming medium P. The image forming medium P bearing the transferred toner images is guided to the nip in the fixing unit 40 with accuracy by the conveying guide 43. The toner images are fixed on the surface of the image forming medium P by heat from the pair of rollers 41*a* and 41*b* in the fixing unit 40 and by the pressure of the nip. The image forming medium P on which the toner images are fixed is carried by the inner discharge roller 44 and the outer discharge roller 45 to be discharged out of the image forming apparatus.

Figure 2:
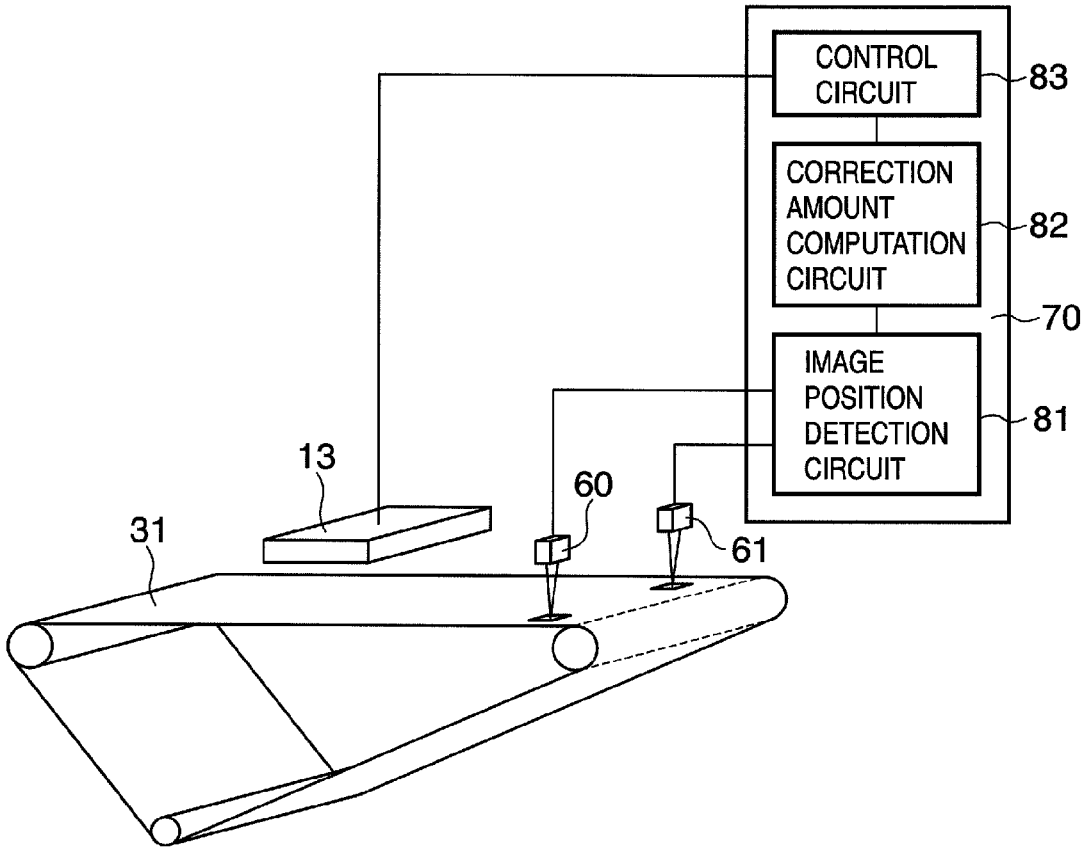
FIG. 2 is a schematic diagram showing a registration correction mechanism according to the embodiment.

FIG. 2 is a schematic diagram showing a registration correction mechanism according to the embodiment. The control unit 70 includes an image position detection circuit 81, a correction amount computation circuit 82, a control circuit 83 and other components as a registration correction mechanism. Detection sensors 60 and 61 are used to read out pattern images for a registration correction. Each of detection sensors 60 and 61 is constituted by a light emitting diode (LED) provided as a light source and a light receiving element which detects reflected light. The image position detection circuit 81 detects the positions at which pattern images are formed on the basis of electrical signals output from the detection sensors 60 and 61. The image position detection circuit 81 also computes an amount of error in color registration from the pattern image formation positions. The correction amount computation circuit 82 computes, from the computed amount of error in color registration, an amount of correction of the formation position with respect to the color to be corrected. The control circuit 83 controls the optical system 13 according to the computed amount of correction. For example, a lens or a mirror of the optical system 13 or timing of light emission from the optical system 13 relating to the image formation position is adjusted. At least one detection sensor 60 is required. However, it is preferable to provide a plurality of detection sensors to improve the correction accuracy.

Figure 3:
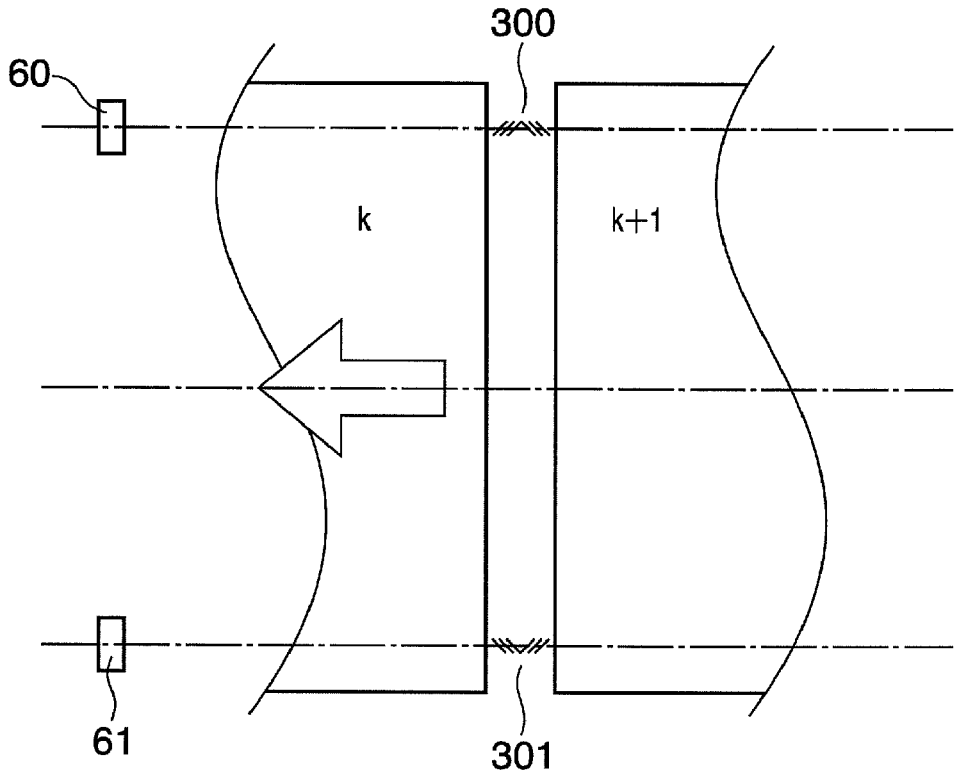
FIG. 3 is a diagram showing an example of formation of pattern images for registration correction on an intermediate transfer member according to the embodiment.

FIG. 3 is a diagram showing an example of formation of pattern images for registration correction (hereinafter referred to as "registration mark") on the intermediate transfer member according to the embodiment. In this example, registration marks 300 and 301 are formed in a space area arisen between the area for formation of the kth (k: integer) image and the area for formation of the (k+1)th image on the intermediate transfer belt 31 (hereinafter referred to as "sheet-to-sheet space"). The arrow in the figure indicates the carrying direction of images.

The registration marks 300 and 301 are formed so as to coincide with the positions at which detection with the detection sensors 60 and 61 can be performed. When the registration marks 300 and 301 pass immediately below the detection sensors 60 and 61, predetermined electrical signals are output from the detection sensors 60 and 61.

Figure 4:
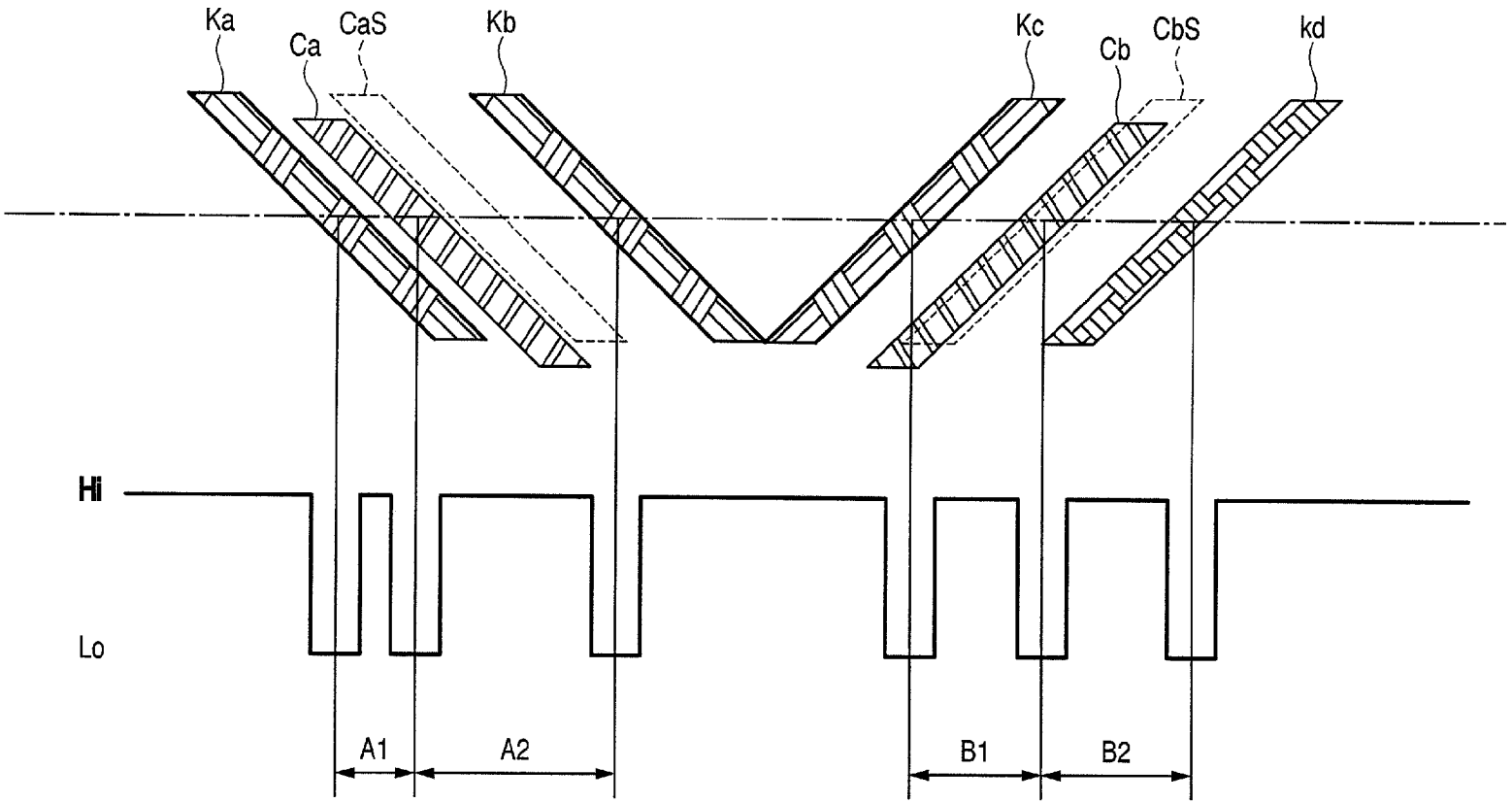
FIG. 4 is a diagram showing an example of the pattern images (registration marks) according to the embodiment.

FIG. 4 is a diagram showing an example of the pattern images (registration marks) according to the embodiment. As shown in FIG. 4, each of the registration marks 300 and 301 has a slanting line Ca of a color to be corrected formed between slanting lines Ka and Kb of a reference color, and a slanting line Cb of a color to be corrected formed between slanting lines Kc and Kd of the reference color.

A case will be considered in which a color registration error of $\Delta V$ has occurred in the main scanning direction (a direction perpendicular to the sheet conveying direction), and in which a color registration error of $\Delta H$ also has occurred in the sub scanning direction (a direction parallel to the sheet conveying direction). That is, images of lines Ca and Cb are formed at positions respectively shifted by $\Delta V$ and $\Delta H$ from lines Cas and Cbs at the ideal positions. Portions of the electrical signals output from the detection sensors 60 and 61 at this time in correspondence with the non-image portions of the mark (the base portion of the intermediate transfer belt 31) are "Hi". On the other hand, portions of the electrical signals corresponding to the image portions of the mark (lines Ka, Ca, Kb, Kc, Cb, and Kd) are "Lo". This means that the reflectivity of the base portion of the intermediate transfer belt 31 is higher than that of the toner images.

It is assumed that the distances between the centroids of the Lo portions are A1, A2, B1 and B2, as shown in FIG. 4. The color registration error ΔV in the main scanning direction and the color registration error ΔH in the sub scanning direction are obtained as $$\Delta V=\{(B2-B1)/2-(A2-A1)/2\}/2, \text{ and}$$

$$\Delta H=\{(B2-B1)/2+(A2-A1)/2\}/2.$$

The correction amount computation circuit 82 computes the amounts of correction of the optical system 13 necessary for reducing the color registration errors ΔV and ΔH. The control circuit 83 corrects the position of the lens or the mirror of optical system 13 or timing of light emission from the optical system 13 according to the computed amounts of correction. Thus, the correction amount computation circuit 82 and the control circuit 83 function as a correction section for correcting the image formation position according to the amounts of error with respect to the colors to be corrected. Thus, the registration is corrected to reduce the amount of color registration error with respect to each color to be corrected.

The above-described correction may be performed by setting all the colors other than the reference color as colors to be corrected. In this way, corrections can be made such that all the colors coincide with the reference color. In actuality, various causes of errors exist. It is, therefore, desirable to determine correction values by performing sampling a certain number of times and performing averaging processing. In particular, there is a need to consider the influence of expansion and contraction of images due to eccentricity of the drive roller 32 for example.

Figure 5:
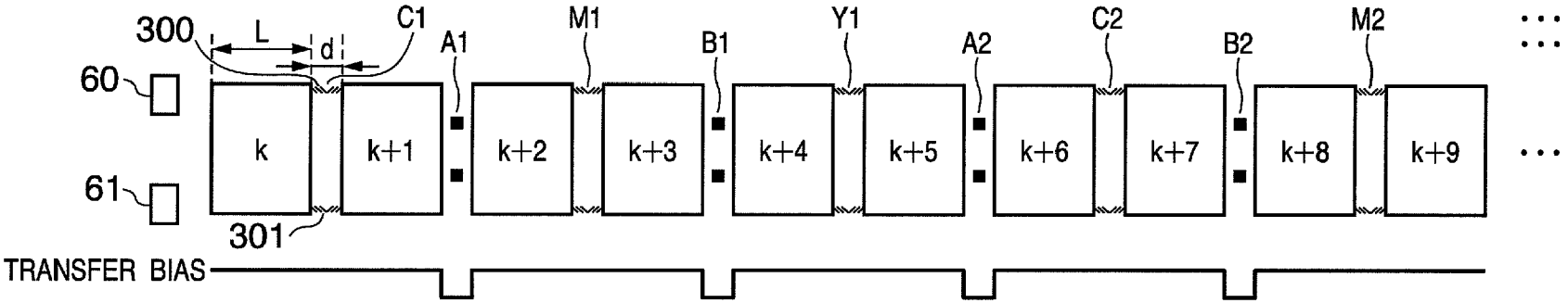
FIG. 5 is a diagram for explaining the placement of the pattern images (registration marks and density correction patches) according to the embodiment.

FIG. 5 is a diagram for explaining an example of images in relation to pattern images (registration marks) formed in sheet-to-sheet spaces according to the embodiment. In this example, density correction patches A1, B1, A2, B2, . . . are formed at positions corresponding to sheet-to-sheet spaces in addition to the registration marks. The density correction patches are respectively formed at predetermined densities on the photosensitive drums 11*a* to 11*d*. The densities of the formed density correction patches are detected with density sensors (not shown) respectively disposed immediately after the development devices 14*a* to 14*d* while being opposed to the photosensitive drums 11*a* to 11*d*. Values based on the detected values of the densities are fed back to the T/D ratio of the developers and development bias values to stabilize the density of images.

Each of the density sensor is constituted by a LED provided as a light source and a light receiving device which detects reflected light. The density correction patch is irradiated with light emitted from the LED, and the density of the formed patch is detected through the amount of reflected light. However, irradiation with the LED for detection operation causes a local increase in surface potential on the photosensitive drum. Further, after application of a transfer bias for transfer onto the intermediate transfer belt 31, potential nonuniformity remains on the photosensitive drum 11 at the time of formation of the next image to act as a cause of an image defect. There is also a problem that transfer of the density correction patches onto the intermediate transfer belt 31 causes an increase in the load in cleaning the secondary transfer device 36 and the intermediate transfer belt 31.

In this embodiment, therefore, a transfer bias of a polarity opposite to that of the transfer bias applied at the time of ordinary image forming is applied during time periods corresponding to the sheet-to-sheet spaces in which the density correction patches are formed, as shown in FIG. 5. Thereby preventing the density correction patches from being transferred from the photosensitive drums 11 onto the intermediate transfer belt 31. The patches for correction of the density of the colors are removed by cleaning with the photosensitive drum cleaning devices 15*a* to 15*d*. Also, a local increase in surface potential on each photosensitive drum is limited to prevent occurrence of an image defect.

Since the densities of formed images vary, there is a need to improve the correction accuracy by frequently performing detection using density correction patches. It is undesirable to continuously form the registration marks in the sheet-to-sheet spaces, since no density correction patches can be formed while the registration marks are being formed. In this embodiment, therefore, the density correction patches and the registration marks are alternatively formed in the sheet-to-sheet spaces.

Needless to say, the ordinary transfer bias is applied during the time periods corresponding to the sheet-to-sheet spaces in which the registration marks are formed, since the registration marks cannot be detected with the detection sensors 60 and 61 unless they are transferred onto the intermediate transfer belt 31. Reducing the voltage of the transfer bias applied during the time periods corresponding to the sheet-to-sheet spaces in which the density correction patches are formed may be performed instead of applying the transfer bias with the opposite polarity. A similar effect can also be achieved in this way.

Figure 6:
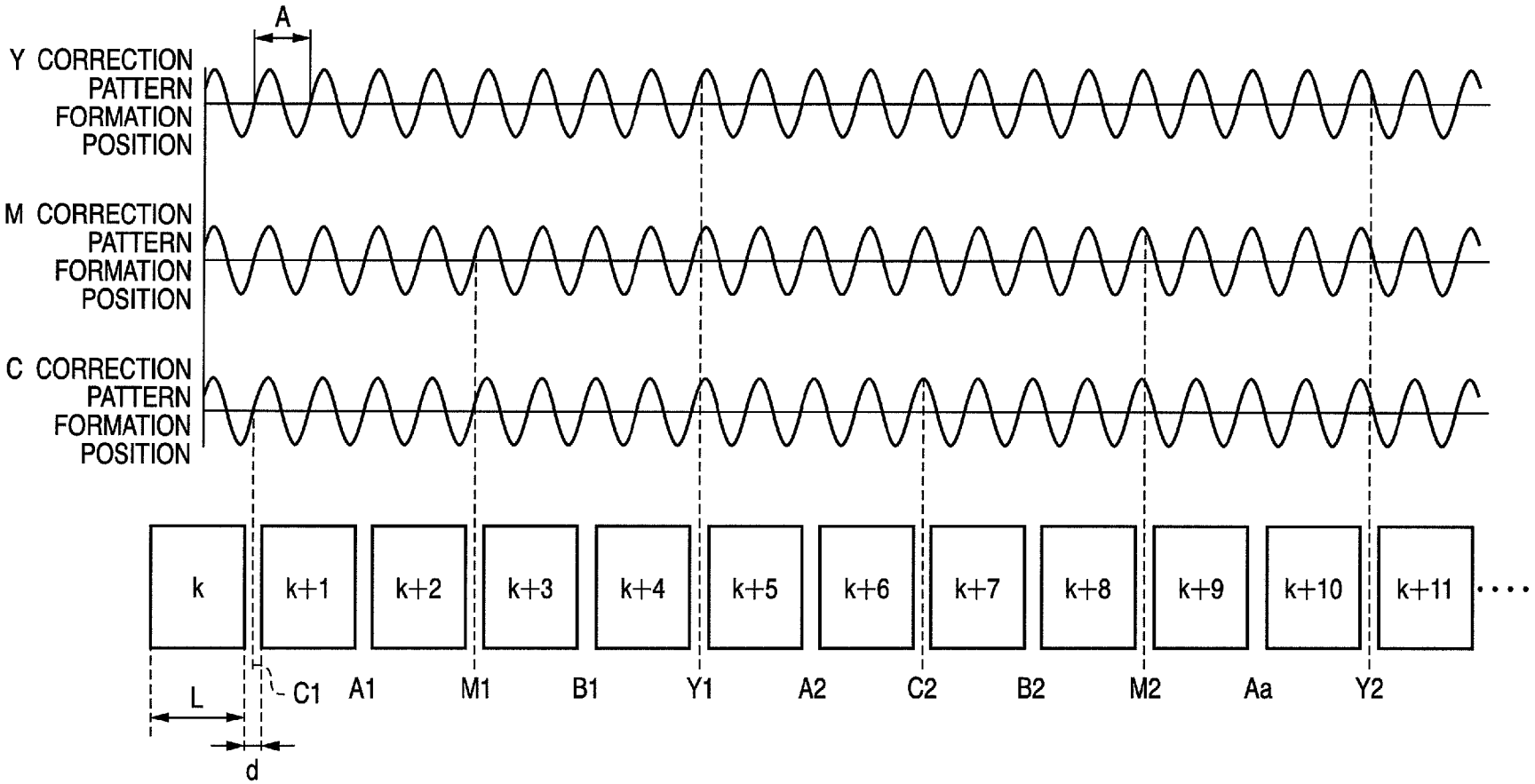
FIG. 6 is a diagram for explaining a phase shift according to the embodiment.

FIG. 6 is a diagram for explaining a phase shift according to the embodiment, showing the relationship between the positions at which the registration marks for the colors to be corrected are formed and the phase of the drive roller 32. If the sheet length in the conveying direction of the image forming medium is L; and the width of the sheet-to-sheet spaces (the length in the conveying direction) is d, the distance between one sheet-to-sheet space and the next sheet-to-sheet space is (L+d). In this embodiment, one registration mark 300 is formed in a cycle of 2×(L+d). A phase difference z between the cycle of formation of the registration mark and the rotation period of the drive roller 32 is considered. When the drive roller 32 rotates through one revolution, the intermediate transfer belt 31 advances through a distance A. The distance A is called a conveying distance in the following description. The phase difference z can be computed by the following equation:

$$z=2\pi\times\{2\times(L+d)/A\times n-1\} \text{ (n: an integer, } -\pi\leqq z\leqq\pi)$$

That is, a shift from the phase of the drive roller 32 corresponding to the phase difference z occurs. When a cumulative value as a result of accumulation of the phase difference z becomes an integer multiple of 2π, the shift from the phase of the drive roller 32 is uniformly distributed. The influence of image expansion and contraction by the drive roller 32 can be reduced by using averaging processing under this condition.

However, if the phase difference z is extremely small, the cumulative value cannot be made an integer multiple of 2π unless the number of times sampling is performed is increased. If the number of times sampling is performed is increased, a longer sampling time is required. Also, the amount of toner consumption is increased, resulting in an increase in running cost. Further, the load on the cleaning device 50 in cleaning of registration mark 300 is considerably increased. It is, therefore, desirable to limit the number of times sampling is performed to a minimum number of times sufficient for execution of average processing.

In this embodiment, therefore, registration marks of cyan (C), magenta (M) and yellow (Y) which are colors to be corrected with respect to a reference color Bk and density correction patches are successively formed alternatively with each other to enable registration correction processing to be completed by performing sampling a minimized number of times. The control unit 70 controls the image forming unit 10 so that the image forming unit 10 forms the ith (i: an integer from 1 to n1) registration marks 300 and 301 with respect to the first of a plurality of colors to be corrected, and thereafter forms the ith registration marks 300 and 301 with respect to the second of the colors to be corrected.

That is, the registration marks are formed in a cycle of two sheet-to-sheet spaces (frequency of arising a sheet-to-sheet space J=2).

More specifically, registration marks C1 for color C to be corrected are formed in the sheet-to-sheet space between the kth and (k+1)th sheets, as shown in FIGS. 5 and 6. Subsequently, density correction patches A1 for Y and M are formed in the sheet-to-sheet space between the (k+1)th and (k+2)th sheets. Further, registration marks M1 for color M to be corrected are formed in the sheet-to-sheet space between the (k+2)th and (k+3)th sheets. Also, density correction patches B1 for C and Bk are formed in the sheet-to-sheet space between the (k+3)th and (k+4)th sheets. Registration marks Y1 for color Y to be corrected are formed in the sheet-to-sheet space between the (k+4)th and (k+5)th sheets. Density correction patches A2 for Y and M are formed in the sheet-to-sheet space between the (k+5)th and (k+6)th sheets. Registration marks C2 for color C to be corrected are formed in the sheet-to-sheet space between the (k+6)th and (k+7)th sheets. In this way, the image forming unit 10 successively forms registration marks M2, Y2, C3, M3, Y3, C4, M4 . . . Cn1, Mn1, and Yn1.

The number of colors to be registration-corrected is the result of subtraction of the number "1" for the reference color during the correction from the total number S of image forming sections provided in the image forming apparatus 100, i.e., (S−1). Accordingly, the number of times n1 the registration marks are formed (the number of times sampling is performed) is given as an integer n1 satisfying $$[2\times(L+d)\times(S-1)/A]\times n1=N1 \quad (1)$$

with respect to each color to be corrected.

It is desirable that N1 be an integer. This is because if N1 is an integer, it is theoretically possible to completely cancel the influence of image expansion and contraction caused by the drive roller 32 to zero. In some cases, however, it is difficult to actually take an integer, depending on the values of L, d and A. Also, if the reproducibility of image expansion and contraction due to various disturbances and other error factors are considered, and if N1 is a value about integer M±0.1, an amount of correction can be obtained with practically sufficient accuracy. Consequently, N1 may be set to a real number close to an integer (approximate integer).

An image forming apparatus will be considered in which total number of image forming sections S=4, sheet length L=216.0 mm, sheet-to-sheet distance d=39.0 mm, and one-drive-roller-revolution belt conveying distance A=125.0 mm. In this case, equation (1) is 12.24×n1=N1. If n1 is 6 to 10, N1=73.44 (the difference from the closest integer: +0.44) when n1=6, N1=85.68 (the difference from the closest integer: −0.32) when n1=7, N1=97.92 (the difference from the closest integer: −0.08) when n1=8, N1=110.16 (the difference from the closest integer: +0.16) when n1=9, and N1=122.40 (the difference from the closest integer: +0.40) when n1=10. N1 is the most approximate integer value when n1=8. From this, it can be understood that setting the number of times n1 the registration marks are formed to 8 may suffice.

Figure 7:
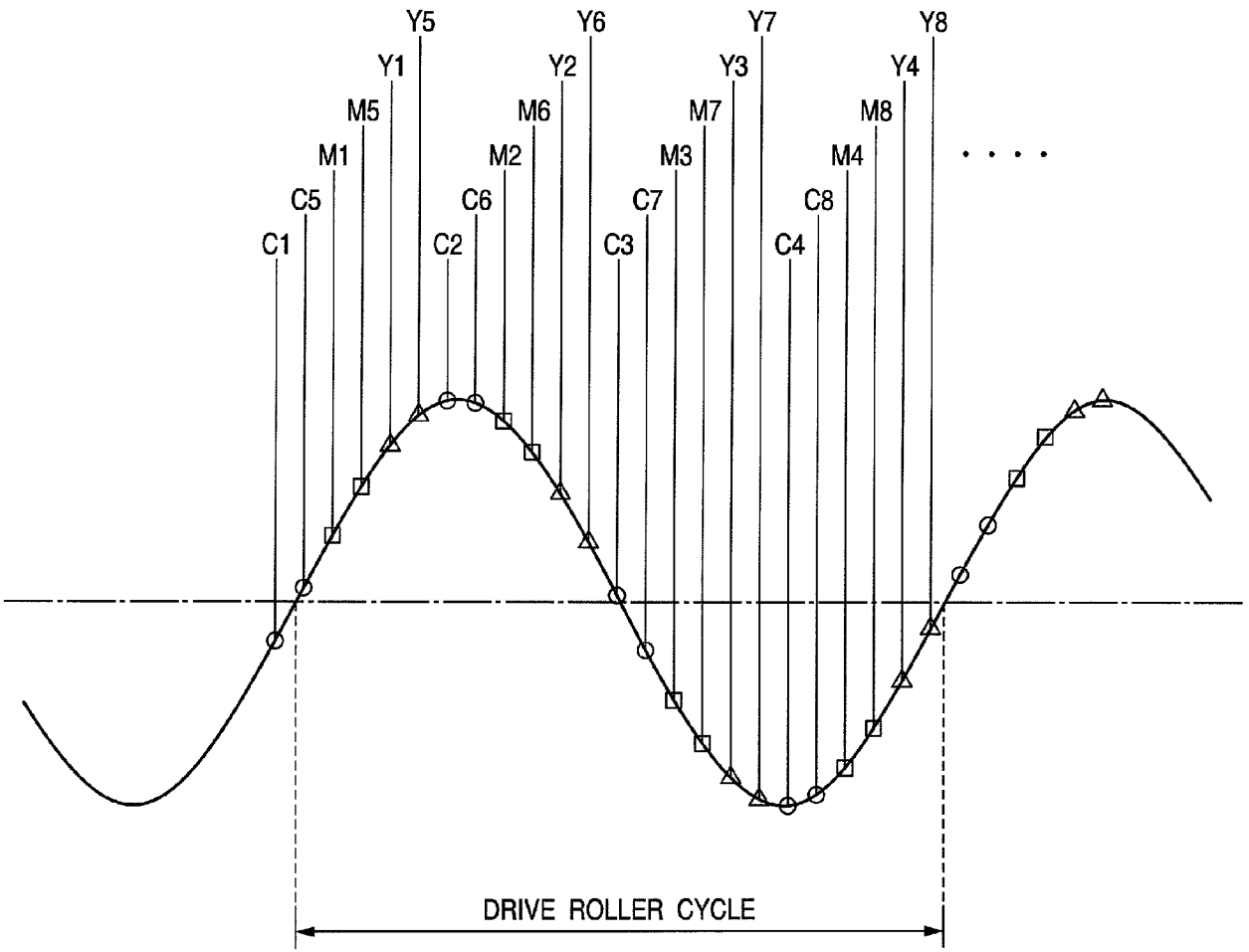
FIG. 7 is a diagram showing the relationship between the phase of rotation of a drive roller and pattern image (registration mark) detection timing according to the embodiment.

FIG. 7 is a diagram showing the relationship between the phase of rotation of the drive roller and pattern image (registration mark) formation timing according to the embodiment. Times at which registration marks C1 to C8, M1 to M8, and Y1 to Y8 in particular are formed are plotted with respect to the phase of rotation of the drive roller 32. One revolution of the drive roller 32 corresponds to one cycle. Thus, the times at which the registration marks for the colors to be corrected are formed are uniformly distributed in one cycle of the drive roller 32. The influence of image expansion and contraction by the drive roller 32 can be reduced by performing averaging processing of detected amounts of registration error. More accurate amounts of correction can be finally obtained.

If n1 is excessively large, problems in terms of required processing time, toner consumption amount, cleaning load and so on arise, as described. If n1 is excessively small, error factors cannot be sufficiently reduced. It is, therefore, desirable to set n1 to an integer from about 6 to about 20.

If sheet length L=216.0 mm and sheet-to-sheet distance d=39.5 mm in the same image forming apparatus 100, N1=134.904 approximate to an integer is obtained from the above equation (1) when n1=11. From this, it can be understood that setting the number of times n1 the registration marks are formed to 11 may suffice.

Execution of jobs in different image forming modes in the above-described image forming apparatus 100 will be considered. In particular, the above-described image forming parameters (e.g., image forming medium length L and sheet-to-sheet distance d) may be changed between different image forming modes. It is, therefore, desirable to compute the suitable number n each time the image forming mode is changed.

Figure 8:
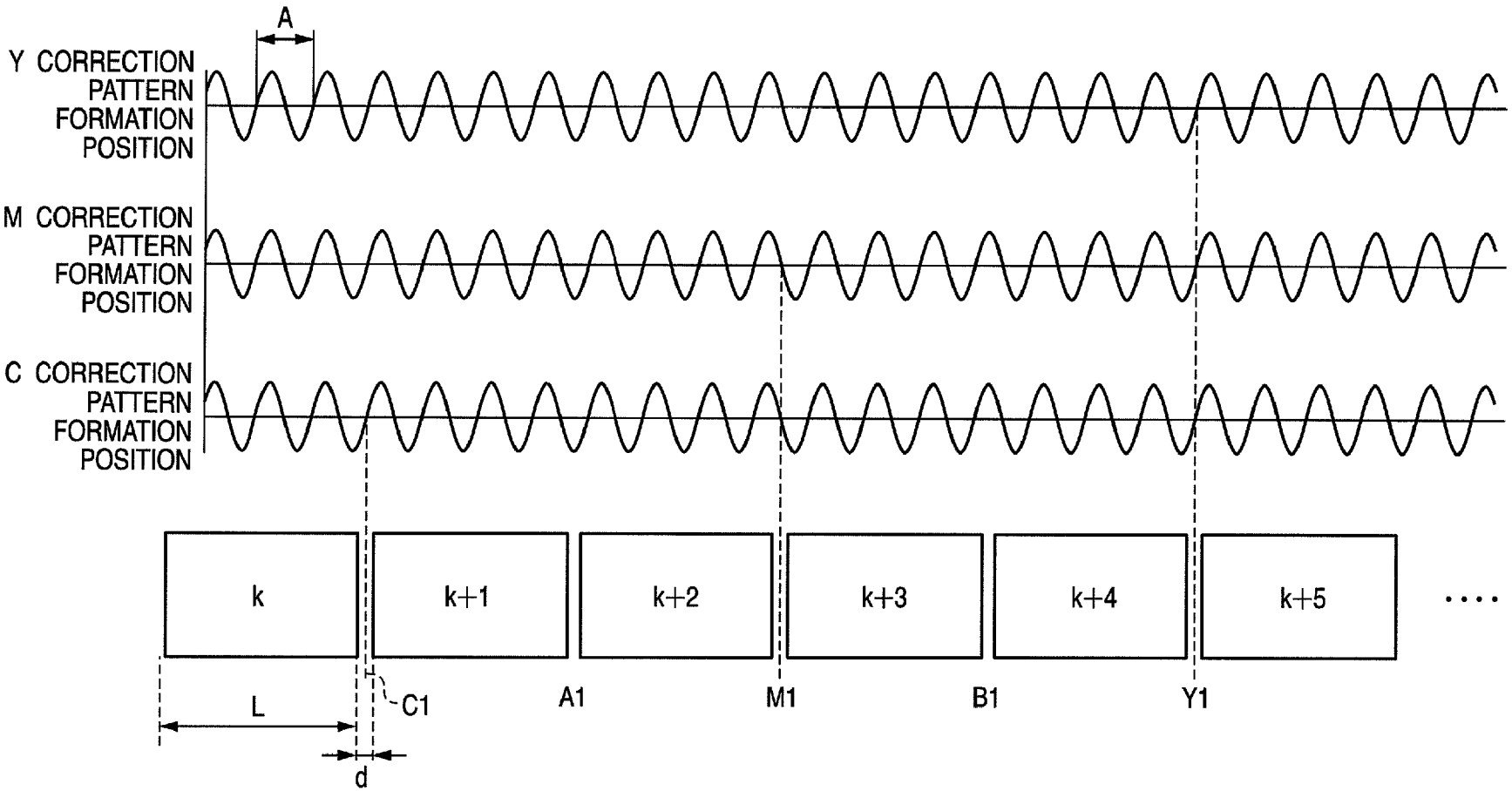
FIG. 8 is a diagram for explaining another phase shift according to the embodiment.

FIG. 8 is a diagram for explaining a phase shift in another example of the apparatus according to the embodiment. In this example, it is assumed that sheet length L=432 mm and sheet-to-sheet distance d=39 mm. N1=226.08 approximate to an integer is obtained from the above equation (1) when n1=10. From this, it can be understood that setting the number of times n1 the registration marks are formed to 10 may suffice.

If sheet length L=432 mm and sheet-to-sheet distance d=39.5 mm in the same image forming apparatus 100, N1=181.056 approximate to an integer is obtained from the above equation (1) when n1=8. From this, it can be understood that setting the number of times n1 the registration marks are formed to 8 may suffice.

As described above, the influence of image expansion and contraction by the drive roller 32 can be reduced in any image forming mode by determining a suitable number of forming times (sampling times) n1 according to the image forming mode. Also, more accurate correction amounts can be obtained to enable suitable correction of color registration errors.

Figure 9:
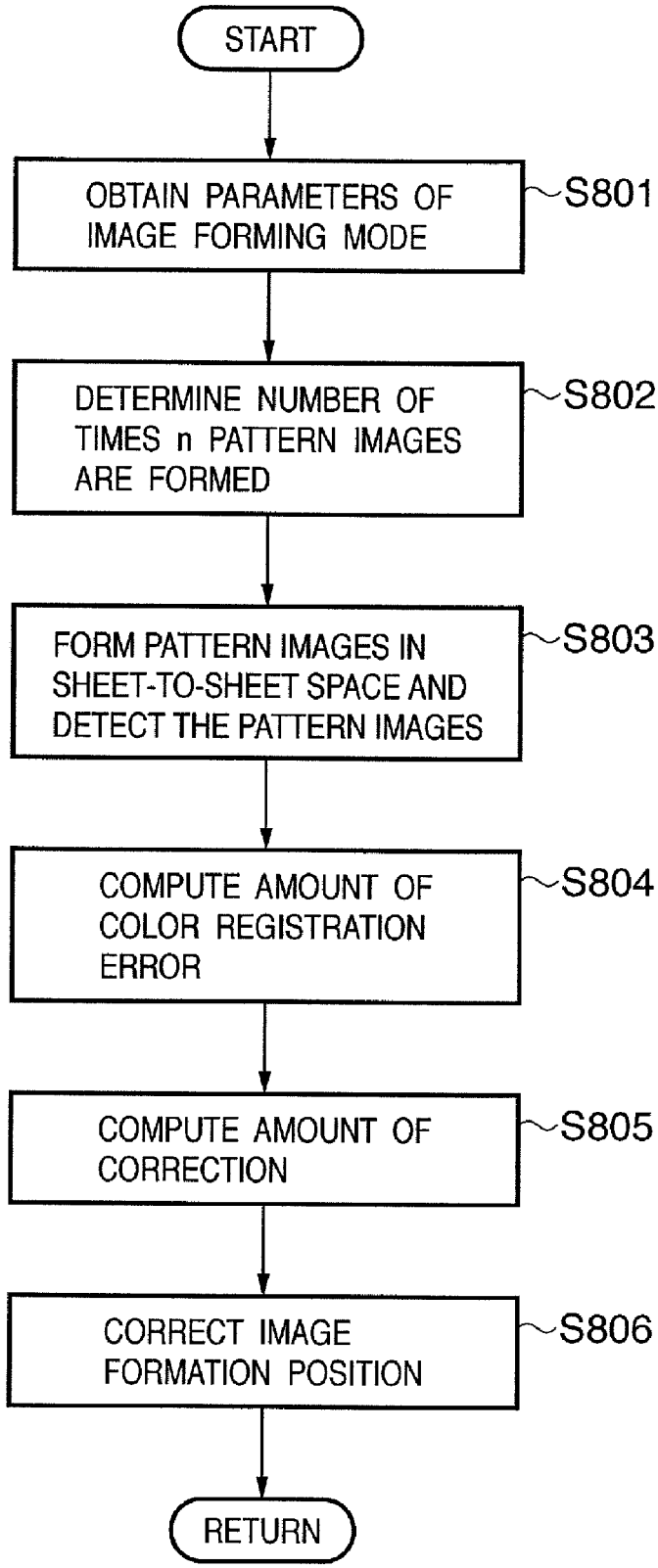
FIG. 9 is a flowchart showing an example of registration correction processing according to the embodiment.

FIG. 9 is a flowchart showing an example of registration correction processing according to the embodiment. The invention according to the above-described embodiment will be summarized with reference to the flowchart.

In step S801, the control unit 70 obtains image forming parameters relating to the present image forming mode. For example, the control unit 70 reads out, as image forming parameters, from a memory or the like, the length L of the image forming medium in the conveying direction, the width d of the sheet-to-sheet space (the length in the conveying direction), the conveying distance A passed by the intermediate transfer member 31 while the drive roller 32 rotates through one revolution and the total number S of image forming sections.

In step S802, the control unit 70 computes the number of times n1 pattern images are formed with respect to one color to be corrected. For example, the control unit 70 computes n1 such that N1 is approximate to an integer by using the above equation (1).

In step S803, the control unit 70 controls the image forming unit 10 so that the image forming unit 10 forms n1 number of pattern images in different n1 sheet-to-sheet spaces. Also, the image position detection circuit 81 of the control unit 70 converts analog detection signals from the detection sensors 60 and 61 into digital signals and stores the converted signals in a RAM or the like.

In step S804, the image position detection circuit 81 of the control unit 70 reads out the detection data from the RAM and computes an amount of color registration error with respect to the color to be corrected. For example, the image position detection circuit 81 computes an average value from n1 amounts of color registration error.

In step S805, the correction amount computation circuit 82 of the control unit 70 computes an amount of correction of the optical system 13 such that the computed amount of color registration error (average value) is cancelled. In step S806, the control circuit 83 of the control unit 70 adjusts the position of the lens or the mirror of the optical system 13 according to the computed amount of correction.

According to this embodiment, as described above, a suitable number of times n the pattern images are formed is determined by considering the parameters with respect to each image forming mode, thereby enabling execution of registration correction with accuracy while reducing the loads on the sections of the image forming apparatus 100.

Also, the control unit 70 controls the image forming unit 10 so that the image forming unit 10 forms the ith (i: an integer from 1 to n1) registration marks 300 and 301 with respect to the first of a plurality of colors to be corrected, and thereafter forms the ith registration marks 300 and 301 with respect to the second of the colors to be corrected, thus enabling registration correction with improved efficiency.

It is desirable that when the image forming mode of the image forming unit 10 is changed, the control unit 70 recomputes the number of times n by using the length L of the image forming medium and the width d of the sheet-to-sheet space with respect to the changed image forming mode. This is because the suitable number of times n is dependent on these parameters.

It is desirable that the approximate integer N be a real number equal to or larger than M−0.1 and equal to or smaller than M+0.1 for arbitrary integer M. If the value of N is a complete integer, the influence of image expansion and contraction can be eliminated. In actuality, however, it is seldom that N is an integer. It is, therefore, desirable to set the number of times n to such a value that N is the most approximate integer value.

Second Embodiment

The above-described belt conveying distance A is set to the optimum value by considering various factors. In ordinary cases, the conveying distance A is determined so to have an integer ratio to the distance D of placement of photosensitive drums 11*a* to 11*d* in order to reduce color registration errors.

The placement distance D is changed among models. Therefore the above-described phase difference z is also changed among models of the image forming apparatus. Also, even in one model, the sheet length L and the sheet-to-sheet distance d vary among job modes and the phase difference z is correspondingly changed. If the phase difference z is a suitable value, n number of registration marks for color C to be corrected with respect to reference color Bk are successively formed. Subsequently, n number of registration marks for color M are successively formed. Finally, registration marks for color Y are also formed in the same way. That is, the control unit 70 controls the image forming unit 10 so that the image forming unit 10 forms the first to nth registration marks C1 to Cn with respect to the first color C to be corrected, and thereafter forms the first to nth registration marks M1 to Mn with respect to the second color M to be corrected, thus enabling registration correction to be completed by the minimum number of times n.

Figure 10:
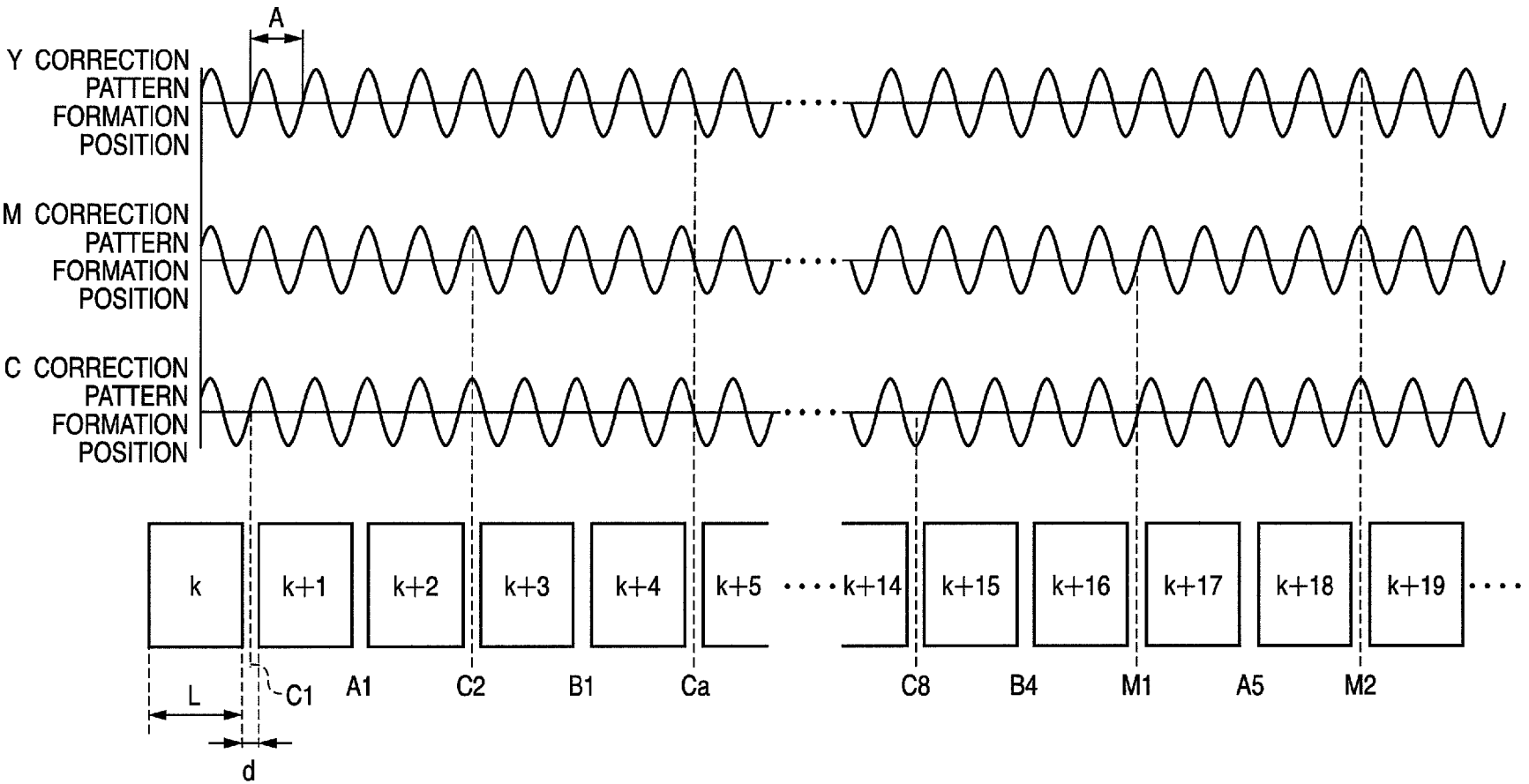
FIG. 10 is a diagram for explaining a phase shift in a second embodiment of the present invention.

FIG. 10 is a diagram for explaining a phase shift in the second embodiment. Registration marks C1 for color C to be corrected are formed in the sheet-to-sheet space between the kth and (k+1)th sheets. Subsequently, density correction patches A1 for Y and M are formed in the sheet-to-sheet space between the (k+1)th and (k+2)th sheets. Further, registration marks C2 are formed in the sheet-to-sheet space between the (k+2)th and (k+3)th sheets. Density correction patches B1 for C and Bk are formed in the sheet-to-sheet space between the (k+3)th and (k+4)th sheets. Registration marks C3 are formed in the sheet-to-sheet space between the (k+4)th and (k+5)th sheets. Density correction patches A2 for Y and M are formed in the sheet-to-sheet space between the (k+5)th and (k+6)th sheets. Registration marks C4 are formed in the sheet-to-sheet space between the (k+6)th and (k+7)th sheets. Registration marks C5, Cg . . . Cn2 (n2: an integer) and density correction patches are alternately formed in the same manner. Further, registration marks M1 to Mn2, and Y1 to Yn2 and density correction patches are alternately formed in the same manner.

The number of times n2 registration marks are repeatedly formed in a cycle of two sheet-to-sheet spaces (frequency of arising a sheet-to-sheet space J=2) is given as an integer n2 satisfying $$[2\times(L+d)/AJ\times n2=N2 \quad (2)$$

with respect to each color to be corrected. It is desirable that N2 be an integer. This is because if N2 is an integer, it is theoretically possible to completely cancel the influence of image expansion and contraction caused by the drive roller 32 to zero. In some cases, however, it is difficult to actually take an integer, depending on the values of L, d and A. Also, if the reproducibility of image expansion and contraction due to various disturbances and other error factors are considered, and if N2 is a value about integer M±0.1, an amount of correction can be obtained with practically sufficient accuracy. Consequently, N2 may be set to a value close to an integer (approximate integer).

An image forming apparatus will be considered in which total number of image forming sections S=4, sheet length L=216 mm, sheet-to-sheet distance d=39.5 mm, and one-drive-roller-revolution belt conveying distance A=120 mm. In this case, according to equation (2), N2=34.067 when n2=8. From this, it can be understood that setting the number of times the registration marks are formed to 8 for each color to be corrected may suffice. That is, registration marks C1 to C8 and density correction patches A1, B1, A2, B2 . . . B4 are formed in the sheet-to-sheet spaces between the kth to (k+16) th sheets, as shown in FIG. 10. Subsequently, registration marks M1 to M8 and density correction patches A5, B5, A6, B6 . . . B8 are formed in the sheet-to-sheet spaces between the (k+16)th to (k+32)th sheets. Further, registration marks Y1 to Y8 and density correction patches A9, B9, A10, B10 . . . B12 are formed in the sheet-to-sheet spaces between the (k+32)th to (k+48)th sheets. The registration marks are read with the detection sensors 60 and 61. Averaging processing may be performed on amounts of color registration error with respect to each color to be corrected. It is also desirable to set n2 to an integer from about 6 to about 20 for the same reason as that described above with respect to n1 in the first embodiment.

Also in the second embodiment, a job in the image forming mode using an image forming medium having a sheet length L of 432 mm is considered. The distance d is assumed to be 39.5 mm. These parameters are substituted in equation (2) to obtain N2=110.017 when n2=14. From this, it can be understood that setting the number of forming times n2 to 14 may suffice.

As described above, when m=1, the control unit 70 controls the image forming unit 10 so that the image forming unit 10 forms the first to nth registration marks with respect to the first color to be corrected. The control unit 70 then controls the image forming unit 10 so that the image forming unit 10 forms the first to nth registration marks with respect to the second color to be corrected, thus enabling registration correction to be completed by the minimum number of times n2. That is, it is possible to execute registration correction with accuracy while reducing the loads on the sections of the image forming apparatus 100.

Third Embodiment

In an image forming apparatus having a number of jobs in various image forming modes, it is desirable to use the smaller one of n1 obtained by equation (1) and n2 obtained by equation (2), because the loads on the sections of the image forming apparatus 100 can be further reduced thereby.

Figure 11:
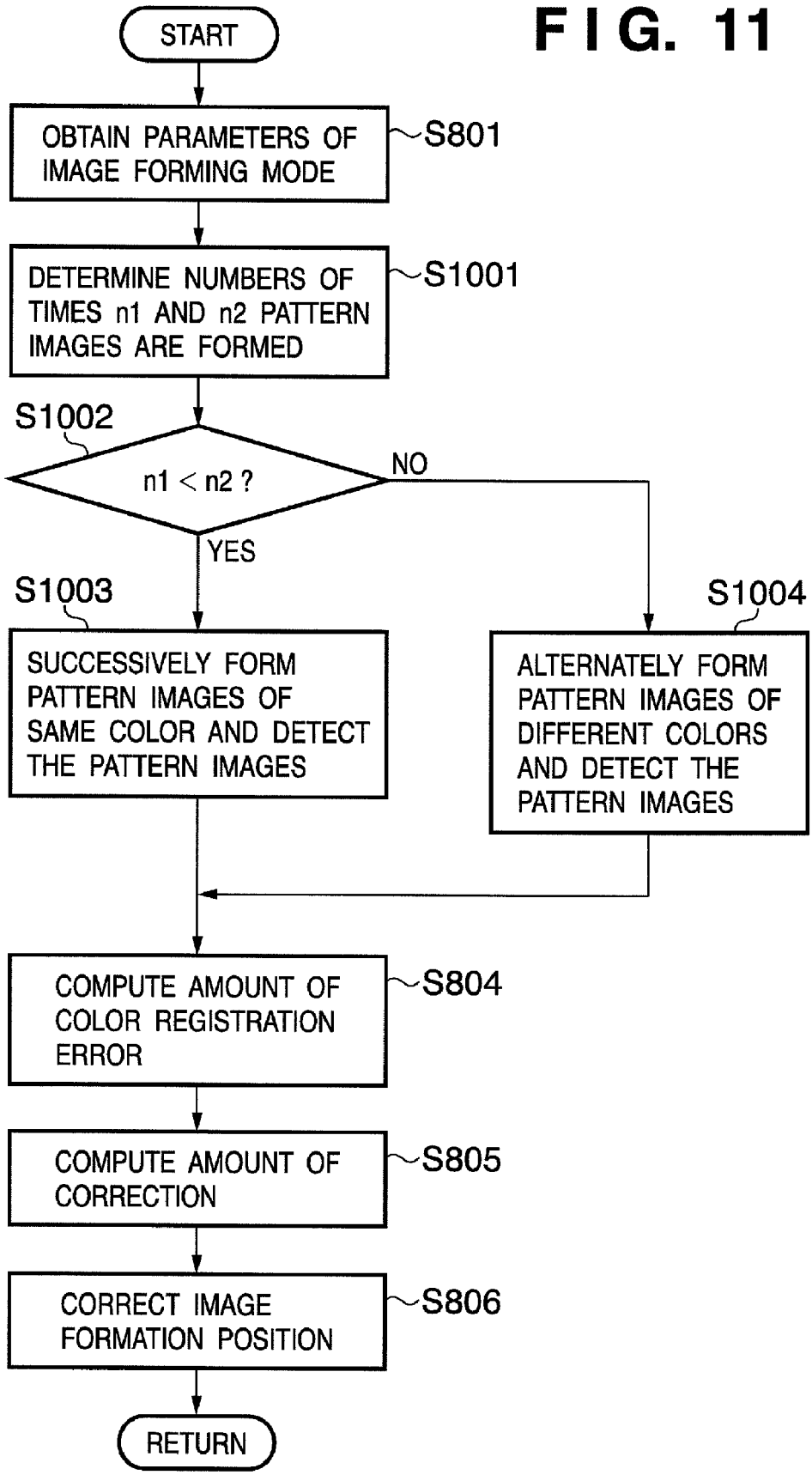
FIG. 11 is a flowchart showing an example of registration correction processing according to a third embodiment of the present invention.

FIG. 11 is a flowchart showing an example of registration correction processing according to the third embodiment. The portions already explained are indicated by the same reference characters, the description for them will not be repeated.

In step S1001, the control unit 70 computes the number of times n1 pattern images are formed with respect to one color to be corrected, by using the above equation (1). The control unit 70 also computes the number of times n2 pattern images are formed with respect to one color to be corrected, by using the above equation (2).

In step S1002, the control unit 70 determines whether or not the number of forming times n1 is smaller than the number of forming times n2. If n1 is smaller, the process advances to step S1003. If n2 is smaller than n1, the process advances to step S1004.

In step S1003, the control unit 70 controls the image forming unit 10 so that the image forming unit 10 forms n1 number of pattern images in different n1 sheet-to-sheet spaces. For example, the control unit 70 first controls the image forming unit 10 so that the image forming unit 10 alternately forms the ith (i: an integer from 1 to n1) registration marks 300 and 301 with respect to the first of a plurality of colors to be corrected, and density correction patches. The control unit 70 then controls the image forming unit 10 so that the image forming unit 10 alternately forms the ith registration marks 300 and 301 with respect to the second of the colors to be corrected, and density correction patches. The control unit 70 thereafter increments the value of i by 1 and executes the same processing. The image position detection circuit 81 of the control unit 70 converts analog detection signals from the detection sensors 60 and 61 into digital signals and stores the converted signals in a RAM or the like.

If n1>n2, the control unit 70 controls the image forming unit 10 in step S1004 so that the image forming unit 10 forms n2 number of pattern images in different n2 sheet-to-sheet spaces. The control unit 70 first controls the image forming unit 10 so that the image forming unit 10 alternately forms the first to n2th registration marks with respect to the first color to be corrected, and density correction patches. The control unit 70 then controls the image forming unit 10 so that the image forming unit 10 alternately forms the first to n2th registration marks with respect to the second color to be corrected, and density correction patches. Also, the image position detection circuit 81 of the control unit 70 converts analog detection signals from the detection sensors 60 and 61 into digital signals and stores the converted signals in the RAM or the like.

Description will be made of a concrete example. For example, an image forming apparatus in which total number of image forming sections S=4, and belt conveying distance A=125 mm is considered. In the case of a job in which sheet length L=216 mm and sheet-to-sheet distance d=39.0 mm in this image forming apparatus, N1=97.92 is obtained from equation (1) when n1=8. Accordingly, setting the number of times the registration marks are formed to 8 may suffice.

However, N2=48.96 is obtained from equation (2) when n2=12. That is, the number of times n2 the registration marks are formed is 12. In this job, therefore, the registration marks for the objects to be corrected are formed in the order described above respect to the first embodiment. For example, the registration marks in the order of C1, M1, Y1, C2, M2, Y2, C3, M3, Y3, C4, M4 . . . C8, M8, Y8 and density correction patches are alternately formed. In this way, accurate correction amounts can be obtained with improved efficiency.

In the case of a job in which sheet length L=432 mm and sheet-to-sheet distance d 79 mm in this image forming apparatus, N1=367.92 is obtained from equation (1) when n1=15. However, N2=49.056 is obtained from equation (2) when n2=6. As a result, setting the number of times the registration marks are formed to 6 may suffice. The registration mark forming order in this case corresponds to that described above with respect to the second embodiment. That is, the registration marks in the order of C1, C2, C3 . . . C6, M1, M2, M3 . . . M6, Y1, Y2, Y3 . . . Y6 and density correction patches are alternately formed. In this way, accurate correction amounts can be obtained with improved efficiency.

According to this embodiment, as described above, the control unit 70 computes a suitable number of times n the registration marks are formed, by using two computation equations relating to different registration mark formation sequences, and executes registration correction processing by selecting a smaller number of forming times, thus making it possible to execute correction processing by using the more suitable registration mark formation sequence and number of forming times according to the image forming mode.

Fourth Embodiment

A correction can be made with higher accuracy by setting and detecting a plurality of densities of each color for the density correction patch. For example, a density correction with a linearity complement can be realized by detecting a solid image patch having the maximum density and a halftone image patch having a lower density.

Figure 12:
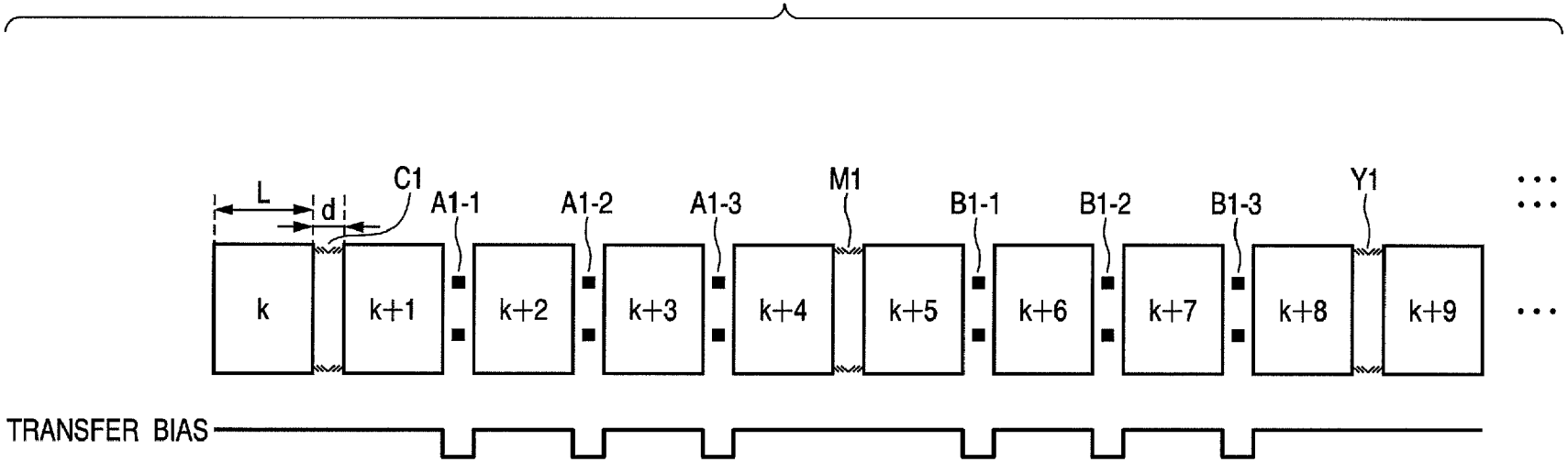
FIG. 12 is a diagram for explaining the placement of pattern images (registration marks and density correction patches) according to a fourth embodiment of the present invention.
Figure 13:
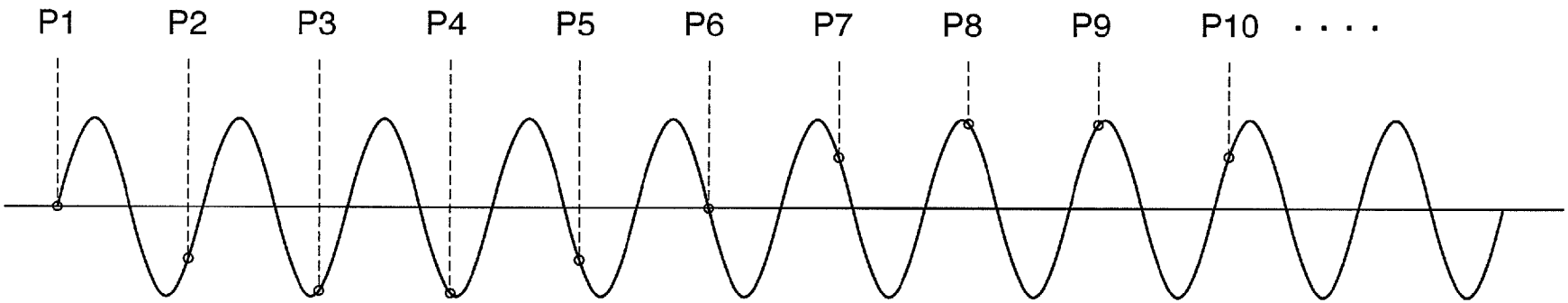
FIG. 13 is a diagram for explaining a phase shift in the conventional art.
Figure 14:
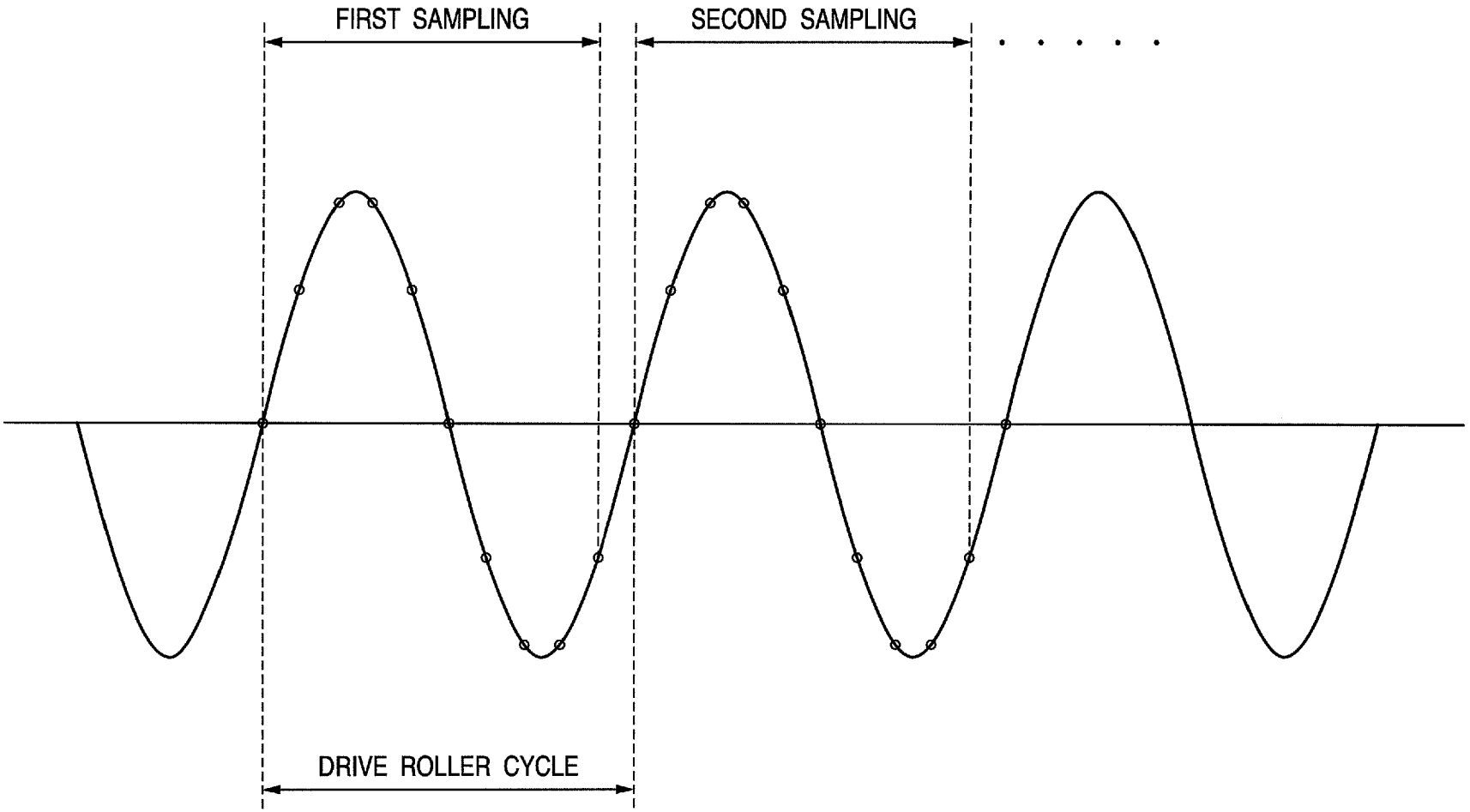
FIG. 14 is a diagram for explaining the number of sampling times in the conventional art.

FIG. 12 is a diagram for explaining a case where three densities are set and detected with respect to each color. It is desirable to form in a minimum time period a series of density correction patches for a color to be corrected in order to detect variation in density with improved accuracy. In this embodiment, density correction patches are formed in three successive sheet-to-sheet spaces, and registration marks are formed in the subsequent sheet-to-sheet space. Density correction patches are also formed in three subsequent successive sheet-to-sheet spaces, and registration marks are formed in the next sheet-to-sheet space. The patches and marks are repeatedly formed in this way and sampling of the registration marks is executed.

More specifically, registration mark C1 for color C to be corrected is formed in the sheet-to-sheet space between the kth and (k+1)th sheets. Subsequently, density correction patches (density level 1) A1-1 for Y and M are formed in the sheet-to-sheet space between the (k+1)th and (k+2)th sheets. Further, density correction patches (density level 2) A1-2 for Y and M are formed in the sheet-to-sheet space between the (k+2)th and (k+3)th sheets, and density correction patches (density level 3) A1-3 for Y and M are formed in the sheet-to-sheet space between the (k÷3)th and (k÷4)th sheets. Registration mark M1 for color M to be corrected is formed in the sheet-to-sheet space between the (k+4)th and (k+5)th sheets. Density correction patches (density level 1) B1-1 for C and Bk are formed in the sheet-to-sheet space between the (k+5)th and (k+6)th sheets. Density correction patches (density level 2) B1-2 for C and Bk are formed in the sheet-to-sheet space between the (k+6)th and (k+7)th sheets. Density correction patches (density level 3) B1-3 for C and Bk are formed in the sheet-to-sheet space between the (k+7)th and (k+8)th sheets. Registration mark Y1 for color Y to be corrected is formed in the sheet-to-sheet space between the (k+8)th and (k+9)th sheets. Thus, the image forming unit 10 successively forms registration marks C2, M2, Y2, C3, M3, Y3, C4, M4 . . . Cn1, Mn1, and Yn1.

That is, the registration marks are formed in a cycle of four sheet-to-sheet spaces (frequency of arising a sheet-to-sheet space J=4). Accordingly, the number of times n1 the registration marks are formed (the number of times sampling is performed) is given as an integer n1 satisfying $$[4\times(L+d)\times(S-1)/AJ\times n1=N1 \quad (3)$$

with respect to each color to be corrected.

In this case, a voltage of the opposite polarity is applied as the transfer bias in the time periods corresponding to the sheet-to-sheet spaces in which the density correction patches are formed.

An image forming apparatus will be considered in which total number of image forming sections S=4, sheet length L=216 mm, sheet-to-sheet distance d=39.5 mm, and one-drive-roller-revolution belt conveying distance A=120 mm. In this case, N1=229.95 is obtained from equation (3) when n1=9. From this, it can be understood that setting the number of times the registration marks are formed to 9 with respect to each color to be corrected may suffice.

A case where the registration marks for one color to be corrected are successively formed in a cycle of four sheet-to-sheet spaces (frequency of arising a sheet-to-sheet space J=4) will be considered.

More specifically, registration mark C1 for color C to be corrected is formed in the sheet-to-sheet space between the kth and (k+1)th sheets. Subsequently, density correction patches (density level 1) A1-1 for Y and M are formed in the sheet-to-sheet space between the (k+1)th and (k+2)th sheets. Further, density correction patches (density level 2) A1-2 for Y and M are formed in the sheet-to-sheet space between the (k+2)th and (k+3)th sheets, and density correction patches (density level 3) A1-3 for Y and M are formed in the sheet-to-sheet space between the (k+3)th and (k+4)th sheets. Registration mark C2 for color C to be corrected is formed in the sheet-to-sheet space between the (k+4)th and (k+5)th sheets. Density correction patches (density level 1) B1-1 for C and Bk are formed in the sheet-to-sheet space between the (k+5)th and (k+6)th sheets. Density correction patches (density level 2) B1-2 for C and Bk are formed in the sheet-to-sheet space between the (k+6)th and (k+7)th sheets. Density correction patches (density level 3) B1-3 for C and Bk are formed in the sheet-to-sheet space between the (k+7)th and (k+8)th sheets. Registration mark C3 for color C to be corrected is formed in the sheet-to-sheet space between the (k+8)th and (k+9)th sheets. Thus, the image forming unit 10 successively forms registration marks C4, C5 . . . Cn2, M1, M2 . . . Mn2, Y1, Y2 . . . . Yn1.

The number of times n2 the registration marks are formed (the number of times sampling is performed) is given as an integer n2 satisfying $$[4\times(L+d)/AJ\times n2=N2 \quad (4)$$

with respect to each color to be corrected.

An image forming apparatus will be considered in which sheet length L=216 mm, sheet-to-sheet distance d=39.5 mm, and one-drive-roller-revolution belt conveying distance A=120 mm. In this case, N2=51.1 when n2=6 is obtained from equation (4). From this, it can be understood that setting the number of times the registration marks are formed to 6 with respect to each color to be corrected may suffice.

Comparing the values of n1 and n2 described above, the value when n2=6 is smaller. Thus, successively forming the registration marks for one color to be corrected in a cycle of four sheet-to-sheet spaces (frequency of arising a sheet-to-sheet space J=4) ensures that an accurate correction amount can be obtained with improved efficiency while the number of registration marks is reduced.

Other Embodiments

Image forming apparatuses using an intermediate transfer system have been described as embodiments of the present invention. That is, the rotating member in the described apparatus is an intermediate transfer member (intermediate transfer belt 31). The present invention, however, can also be applied to image forming apparatuses using a direct transfer system. In image forming apparatuses using a direct transfer system, the need for the intermediate transfer member is eliminated and an image forming medium is carried by being attracted to a surface of a conveyer belt provided as a rotating conveyer. Also, images are successively transferred from photosensitive drums onto the image forming medium. In this case, the conveyer belt corresponds to the rotating member.

An example of determination of the number of times pattern images are formed according to each of different modes has been described as an embodiment of the present invention. Needless to say, the number of forming times may be determined as occasion demands or may be determined in advance. Also, the number of forming times may be determined by computation or by reading out from a memory or the like a value stored in advance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of

Japanese Patent Application No. 2005-255622, filed Sep. 2, 2005, 2006-175573, filed Jun. 26, 2006, which are hereby incorporated by reference herein in their entirety.

What is claimed is:

1. An image forming apparatus, comprising:

a rotating member which is one of an intermediate transfer member and a rotating conveyer which conveys an image forming medium, the intermediate transfer member temporarily holds an image to be transferred onto the image forming medium;

a drive roller which drives the rotating member;

a plurality of image forming sections which respectively form images of different colors on the rotating member or the image forming medium;

a control section which forms a pattern image in a reference color and one of the colors to be corrected, by using the image forming sections, in a space area on the rotating member arisen between a first area in which an image corresponding to a first image forming medium is formed and a second area in which an image corresponding to a second image forming medium is formed;

a detection section which reads a plurality of the formed pattern images to detect an amount of misalignment of the image formation position of the color to be corrected against the image formation position of the reference color; and a correction section which corrects the image formation position of the color to be corrected according to the amount of misalignment;

wherein the control section controls the image forming sections so that the image forming sections form the pattern image a number of times n (n: an integer) expressed by equation:

$$[J\times(L+d)\times m/A]\times n=N$$

using a predetermined integer J, the length L of the image forming medium, the width d of the space area, the conveying distance A passed by the rotating member while the drive roller rotates through one revolution, a predetermined integer m, and an approximate integer N; and wherein the control section controls the image forming sections so that if the total number of the image forming sections is S, the image forming sections form the pattern image the number of times corresponding to the smaller of n1 determined as n by assuming that m=1 and n2 determined as n by assuming that m=S−1.

2. The image forming apparatus according to claim 1, wherein the pattern image is formed each time the space area is arisen the number of times corresponding to the predetermined integer J.

3. The image forming apparatus according to claim 1, wherein the control section controls the image forming sections so that the image forming sections form the ith (i: an integer from 1 to n) pattern image with respect to the first of a plurality of the colors to be corrected, and thereafter form the ith pattern image with respect to the second of the colors to be corrected.

4. The image forming apparatus according to claim 1, wherein the control section controls the image forming sections so that the image forming sections form the first to nth pattern images with respect to the first color to be corrected, and thereafter form the first to nth pattern images with respect to the second color to be corrected.

5. The image forming apparatus according to claim 1, wherein when the image forming mode in the image forming sections is changed, the control section determines the number of times n by using the length L of the image forming medium and the width d of the space area with respect to the image forming mode.

6. The image forming apparatus according to claim 1, wherein the number of times n ranges from 6 to 20, inclusive.

7. The image forming apparatus according to claim 1 wherein, with respect to an arbitrary integer M, the value N is a real number equal to or larger than M−0.1and equal to or smaller than M+0.1.

8. The image forming apparatus according to claim 1, wherein the detection section obtains an average value from amounts of misalignment obtained with respect to the plurality of pattern images.

* * * * *